US006012916A

United States Patent [19]

Liang

[11] Patent Number: 6,012,916

[45] Date of Patent: Jan. 11, 2000

[54] SAFETY ELECTRONIC LIGHTER

[76] Inventor: Chung-Ho Liang, 2/F., No. 66, Sec. 3., Cheng-Tai Rd. Wu-Ku Village, Taipei County, Taiwan

[21] Appl. No.: 09/228,621

[22] Filed: Jan. 12, 1999

[51] Int. Cl.[7] ..... F23D 11/36

[52] U.S. Cl. ..... 431/153; 431/255

[58] Field of Search ..... 431/153, 255

[56] References Cited

U.S. PATENT DOCUMENTS 5,496,169 3/1996 Chen ..... 431/153

5,865,614 2/1999 Hsu ..... 431/255

*Primary Examiner*—Carroll Dority

*Attorney, Agent, or Firm*—Rosenberg, Klein & Lee

[57] ABSTRACT

A safety electronic lighter includes an ignition control switch, which is operated to drive a high voltage coil, causing it to discharge sparks, the ignition control switch being rotatable between the operative position and the non-operative position, a safety lock, which is operated to lock the ignition control switch, prohibiting the ignition control switch from operation, a first power control switch, which is operated to switch on/off the power supply circuit of the electronic lighter, a second power control switch connected in series to the first power control switch, the second power control switch being mounted inside the housing of the electronic lighter and kept from sight and accessible by a rod member through a hole at the housing of the electronic lighter.

11 Claims, 9 Drawing Sheets

SAFETY ELECTRONIC LIGHTER

BACKGROUND OF THE INVENTION

The present invention relates to electronic lighters, and more particularly to a safety electronic lighter which has a safety lock, that can be controlled to lock an ignition control switch, prohibiting the electronic lighter from being operated.

A regular electronic lighter generally comprises a gas control switch, which is operated to let fuel gas be discharged out of a gas tank to a flame tube through a gas tube, an ignition switch, which is operated to discharge a high voltage in producing sparks for ignition discharged fuel gas, and a flame control knob, which is operated to regulate the flow rate of discharged fuel gas. This structure of electronic lighter is complicated. Further, this structure of electronic lighter is not safe in use, because it can easily be operated by a young child. U.S. Pat. No. 5,199,865, which was issued to the present inventor, discloses a foldable safety lighter in which the control knob, which controls a gas tube to discharge gas and an electric igniter to discharge sparks, can be rotated to a locking position to prevent accidental triggering thereof. Because the control knob can easily be rotated out of the locking position by a young child, an accidental triggering may occur when a young child keep the foldable safety lighter at hand.

SUMMARY OF THE INVENTION

The present invention has been accomplished to provide a safety electronic lighter which eliminates the aforesaid drawbacks. According to one aspect of the present invention, an ignition control switch is provided, and operated to drive a high voltage coil, causing it to discharge sparks. The ignition control switch can be rotated between the operative position, and the non-operative position. According to another aspect of the present invention, a safety lock is provided, and operated to lock the ignition control switch, prohibiting the ignition control switch from operation. According to still another aspect of the present invention, a first power control switch is provided at the bottom side of the housing of the electronic lighter, and operated to switch on/off the power supply circuit. The high voltage coil can be controlled to discharge sparks only after the power supply circuit has been switched on. According to still another aspect of the present invention, a second power control switch is installed in the housing of the electronic lighter, and kept from sight. The power supply circuit is closed only when the first power control switch and the second power control switch are switched on. When switching the second power switch, a rod member or the like must be used and inserted through a hole at the bottom side of the housing of the electronic lighter to move the press button of the second power control switch. The aforesaid four safety designs, namely, the ignition control switch, the safety lock, the first power control switch and the second power control switch prevent an accidental triggering of the electronic lighter.

DETAILED DESCRIPTION OF THE PREFERRED EMBODIMENT

Figure 1:
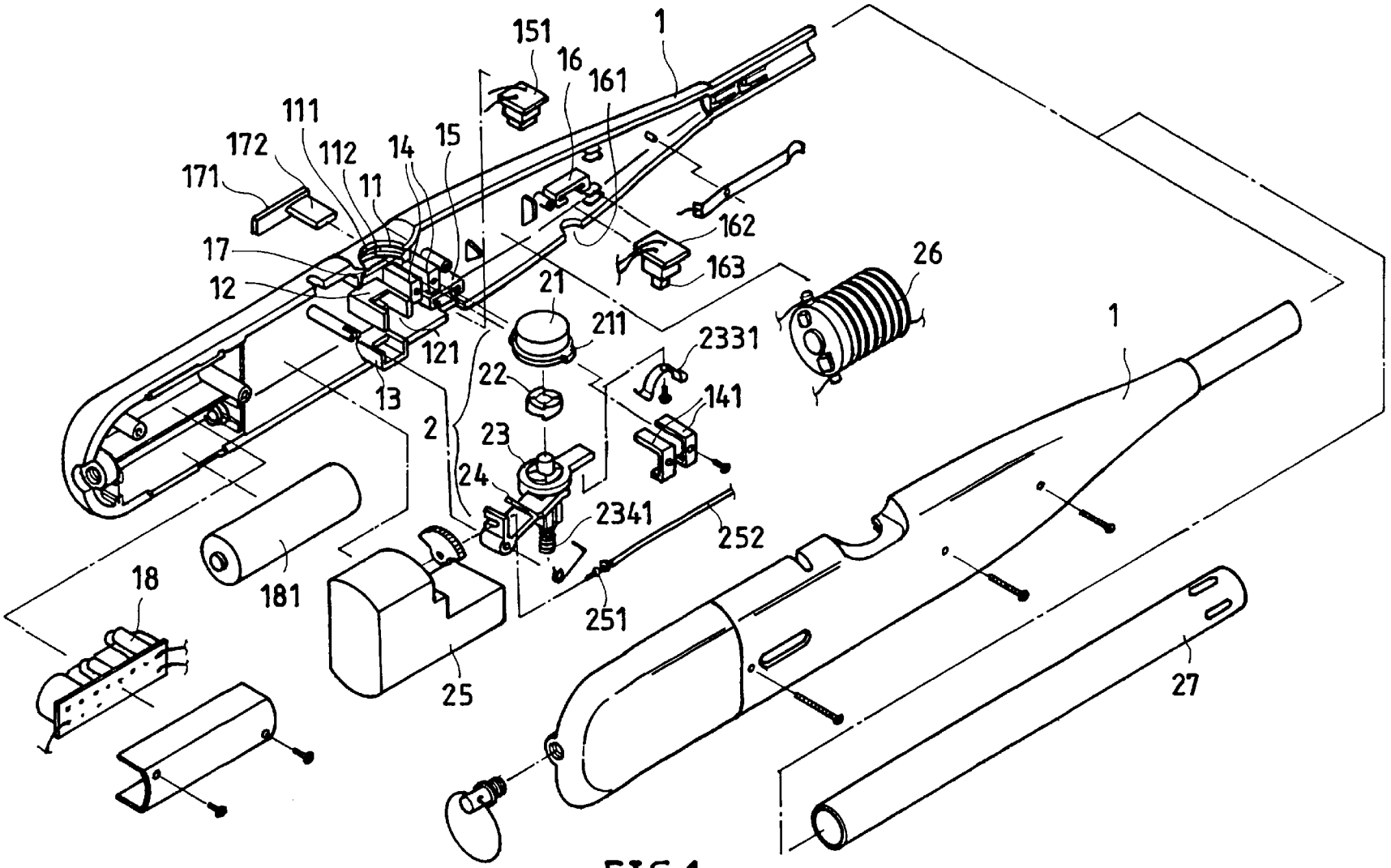
FIG. 1 is an exploded view of a safety electronic lighter according to a first embodiment of the present invention.
Figure 2:
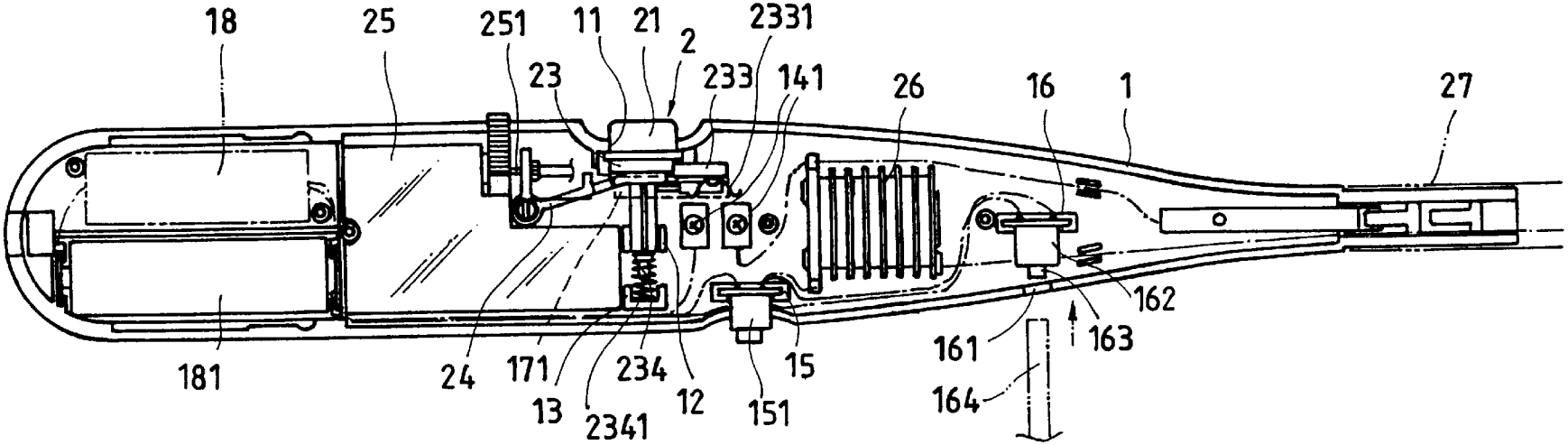
FIG. 2 is a sectional assembly view of the safety electronic lighter shown in FIG. 1.
Figure 3:
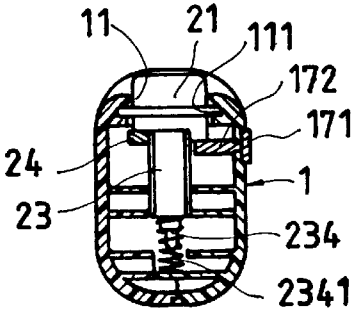
FIG. 3 is a cross sectional view of FIG. 1, showing the stop rod of the safety lock stopped below the control bar.
Figure 4:
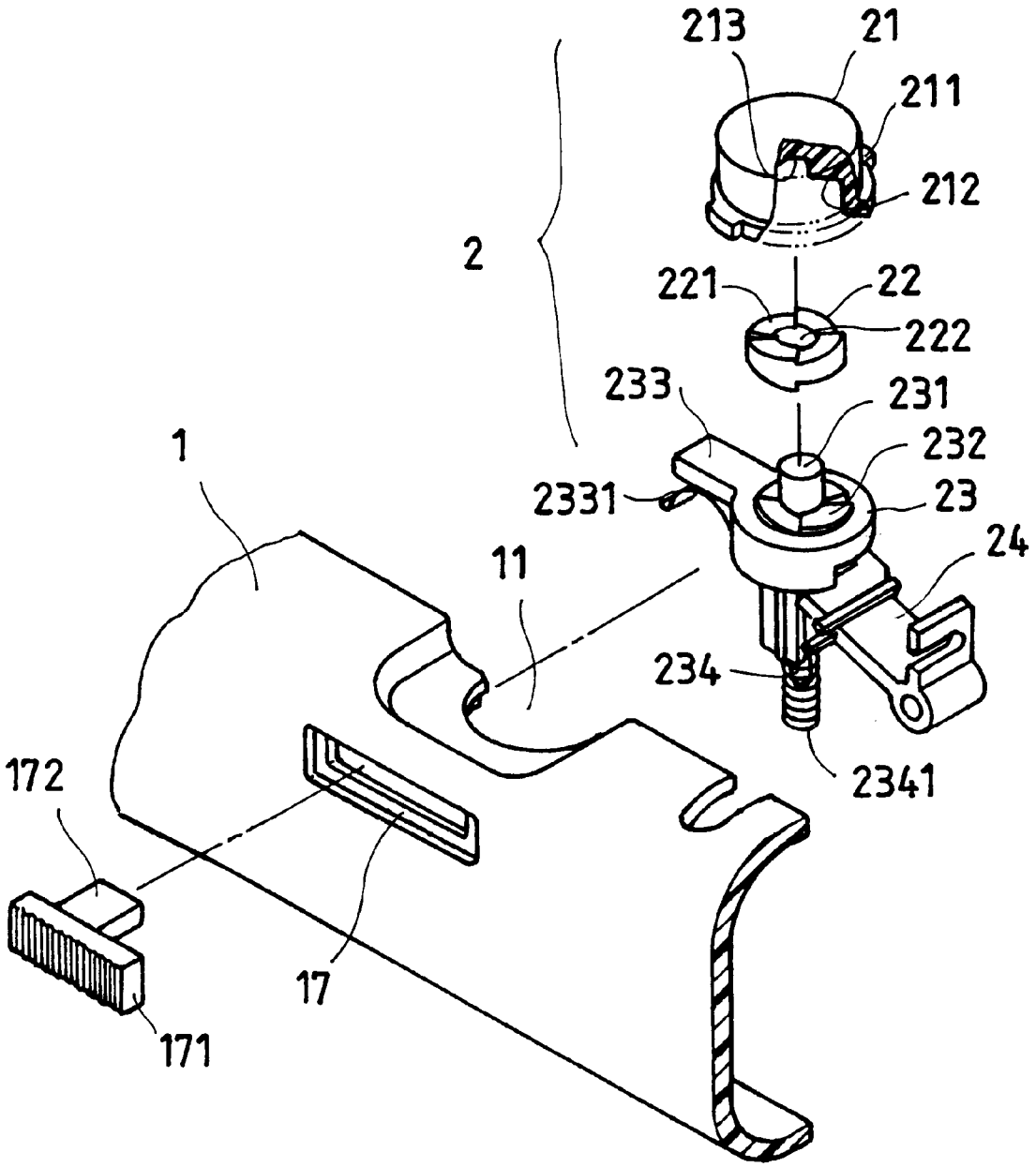
FIG. 4 is an exploded view in an enlarged scale of the first embodiment of the present invention, showing the arrangement of the ignition control switch.

Referring to FIGS. from 1 through 4, a safety electronic lighter in accordance with the present invention is generally comprised of a housing, which is formed of two outer shells 1 and 1', and an ignition control switch 2 mounted in a hole 11 at the top side of the housing of the outer shells 1 and 1' on the middle. The ignition control switch 2 is comprised of a control knob 21, a driving element 22, and a control bar 23. The control bar 23 is mounted in an opening 121 at a projecting frame 12 at one outer shell 1, having a bottom pin 234 downwardly extended from its bottom side, a top pin 231 raised from its top side, a plurality of bevel steps 232 at its top side around the root of the top pin 231, an extension 233, and a metal strip 2331 at the end of the extension 233. A spring 2341 is mounted on a substantially U-shaped holder plate 13 at one outer shell 1 around the bottom pin 234 below the projecting frame 12. The spring 2341 supports the control bar 23 on the holder plate 13. The driving element 22 comprises a center hole 222, which receives the top pin 231 of the control bar 23, and two sets of bevel steps 221 respectively disposed at its top and bottom sides around the center hole 222. The bevel steps 221 at the bottom side of the driving element 22 are meshed with the bevel steps 232 at the control bar 23. The control knob 21 is covered on a part of the control bar 23, having a bottom chamber 213, which receives the driving element 22, a plurality of bevel steps 212 disposed inside the bottom chamber 213 and meshed with the bevel steps 221 at the top side of the driving element 22, and two projecting rods 211 raised from the periphery at two opposite sides and respectively inserted in respective grooves 111 at the bottom side of the hole 11 for enabling the control knob 21 to be rotated clockwise/counterclockwise within 90° angle. Stop strips 112 are provided in the grooves 111 to limit the angle of rotation of the control knob 21 within 90° angle, i.e., the control knob 21 is permitted to rotate through 90° angle in clockwise as well as counter-clockwise direction (see also FIGS. from 6A through 6C). Two metal contacts 141 are respectively mounted on a respective lug 14 at one outer shell 1, and connected to power supply by a respective conductor. When the ignition control switch 2 is pressed down, the metal strip 2331 is forced into contact with the metal contacts 141, thereby causing the electric circuit to be closed. On the contrary, when the ignition control switch 2 is released, the control bar 23 is pushed upwardly back to its former position, and the metal strip 2331 is moved with the control bar 23 from the metal contacts 141 to disconnect the electric circuit.

A high voltage coil 26 is provided in the housing of the outer shells 1 and 1' near the front side, and connected to a control circuit 18 and a battery 181. The control circuit 18 controls the high voltage coil 26 to discharge a high voltage in producing sparks for igniting fuel gas. A first power control switch 151 is mounted in a switch holder 15 at one outer shell 1, and operated to close/open the power circuit. A second power control switch 162 is mounted in a switch holder 16 near the front side of one outer shell 1 on the inside. The second power control switch 162 has a press button 163 aimed at a hole 161 at the bottom side of the housing of the outer shells 1 and 1'. When operating the second power control switch 162, a rod member 164 or the like is inserted through the hole 161 and pressed on the press button 163 to switch on/off the second power control switch 162. When igniting fuel gas, the control knob 21 is rotated to such a position that the projecting rods 211 are aimed at respective notches 113 at the housing of the outer shells 1 and 1', then the rod member 164 is inserted through the hole 161 to switch on the second power control switch 162, and then the control knob 21 of the ignition control switch 2 and the first power control switch 151 are simultaneously depressed to close the circuit of the high voltage coil 26, the control circuit 18 and the battery 181, enabling the high voltage coil 26 to discharge a high voltage in producing sparks.

A safety lock 171 is moved in a sliding slot 17 at one lateral side of the housing of the outer shells 1 and 1' to lock/unlock the ignition control switch 2. The safety lock 171 has a stop rod 172. When the safety lock 171 is shifted to the locking position, the stop rod 172 is stopped below the control bar 23 to prohibit the ignition control switch 2 from downward movement, and at the same time the control knob 21 is prohibited from rotary motion. On the contrary, when the safety lock 171 is shifted to the unlocking position; the stop rod 172 is moved away from the control bar 23, enabling the ignition control switch 2 to be depressed. When the ignition control switch 2 is depressed, the valve 251 of the gas tank, referenced by 25, is pulled open by a pull rod 24 of the control bar 23, enabling fuel gas to flow out of the gas tank 25 through a gas tube 252 to a flame tube 27 at the front side of the housing of the outer shells 1 and 1'.

Figure 5:
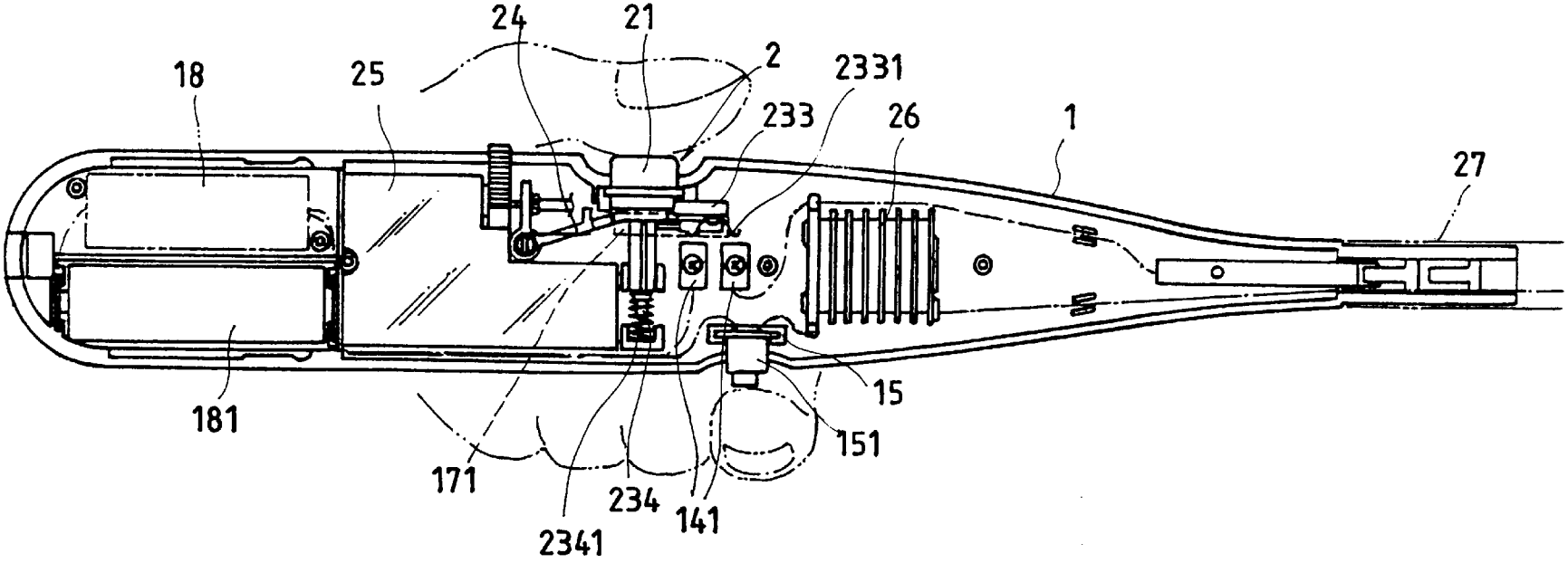
FIG. 5 is a sectional assembly view of a safety electronic lighter according to a second embodiment of the present invention.
Figure 6C:
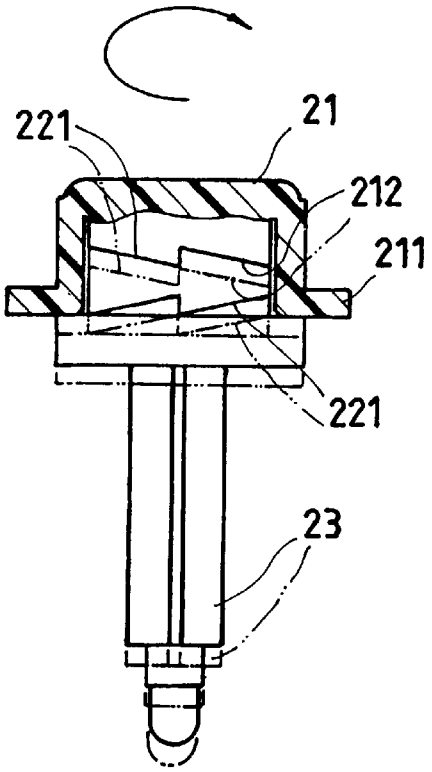
FIG. 6C is a schematic drawing showing the control knob of the ignition control switch rotated in clock-wise direction.
Figure 6B:
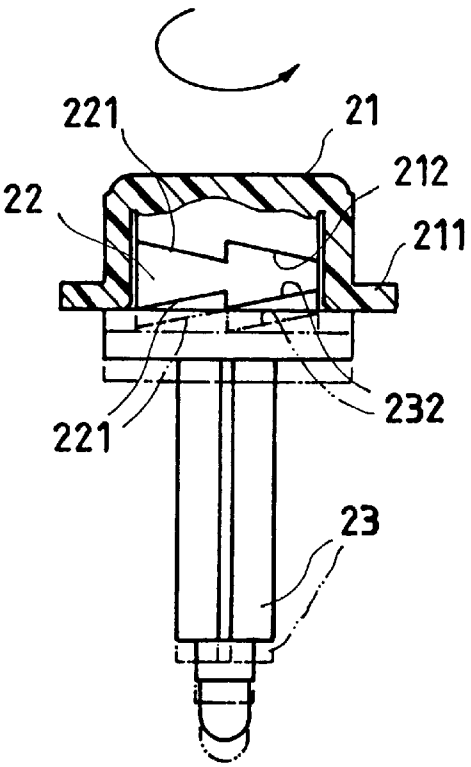
FIG. 6B is a schematic drawing showing the control knob of the ignition control switch rotated in counter-clockwise direction.
Figure 6A:
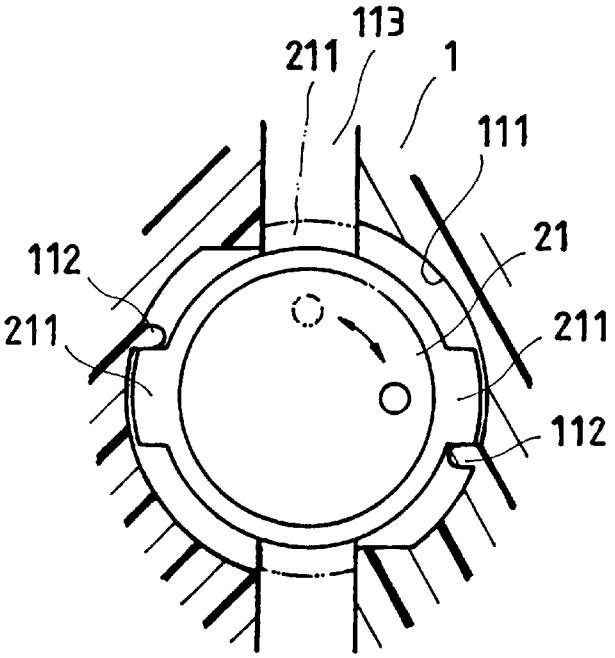
FIG. 6A is a sectional view in an enlarged scale showing the positioning of the control knob in the grooves at the housing of the outer shells.
Figure 7:
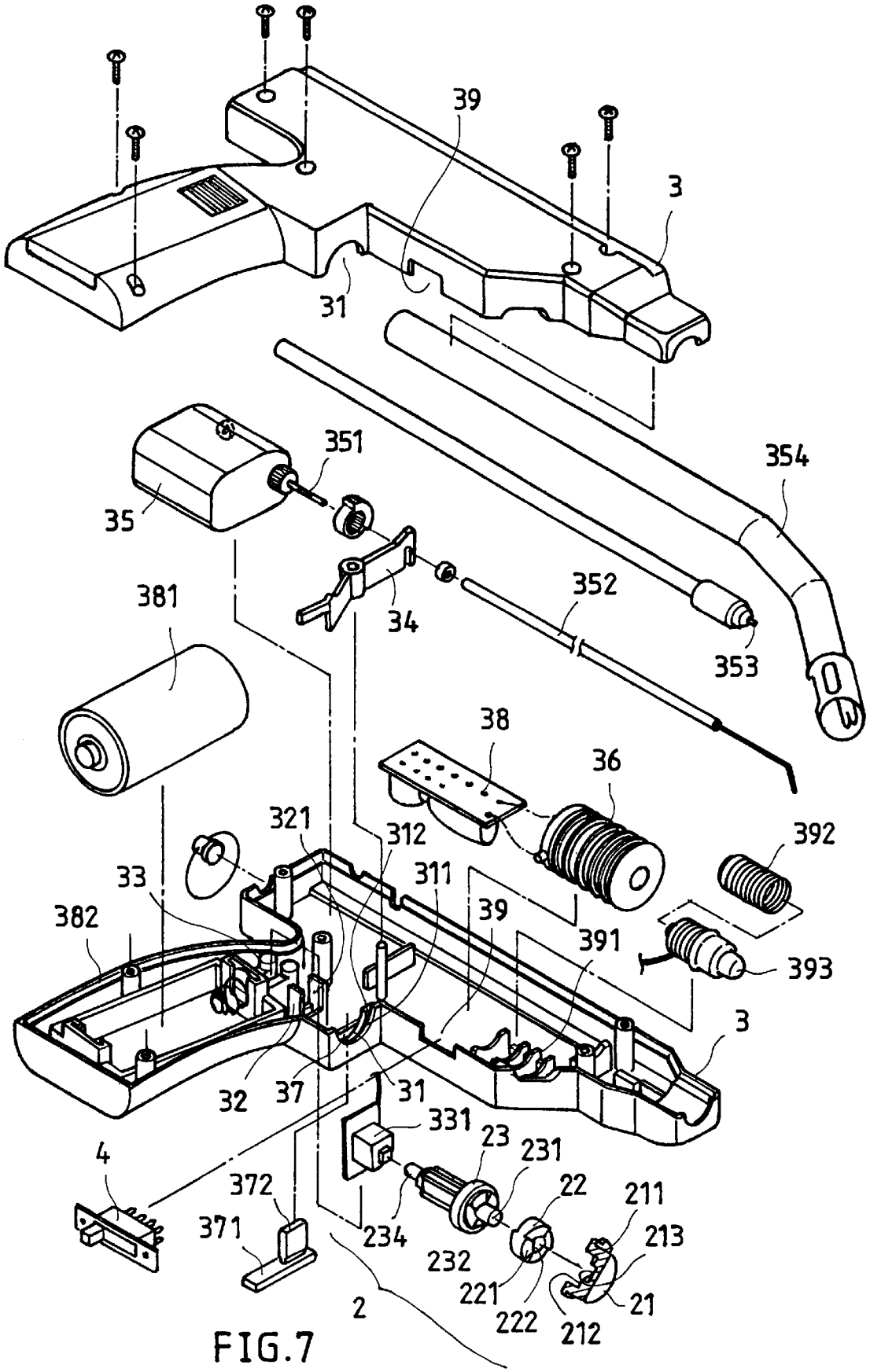
FIG. 7 is an exploded view of a safety electronic lighter according to a third embodiment of the present invention.
Figure 8:
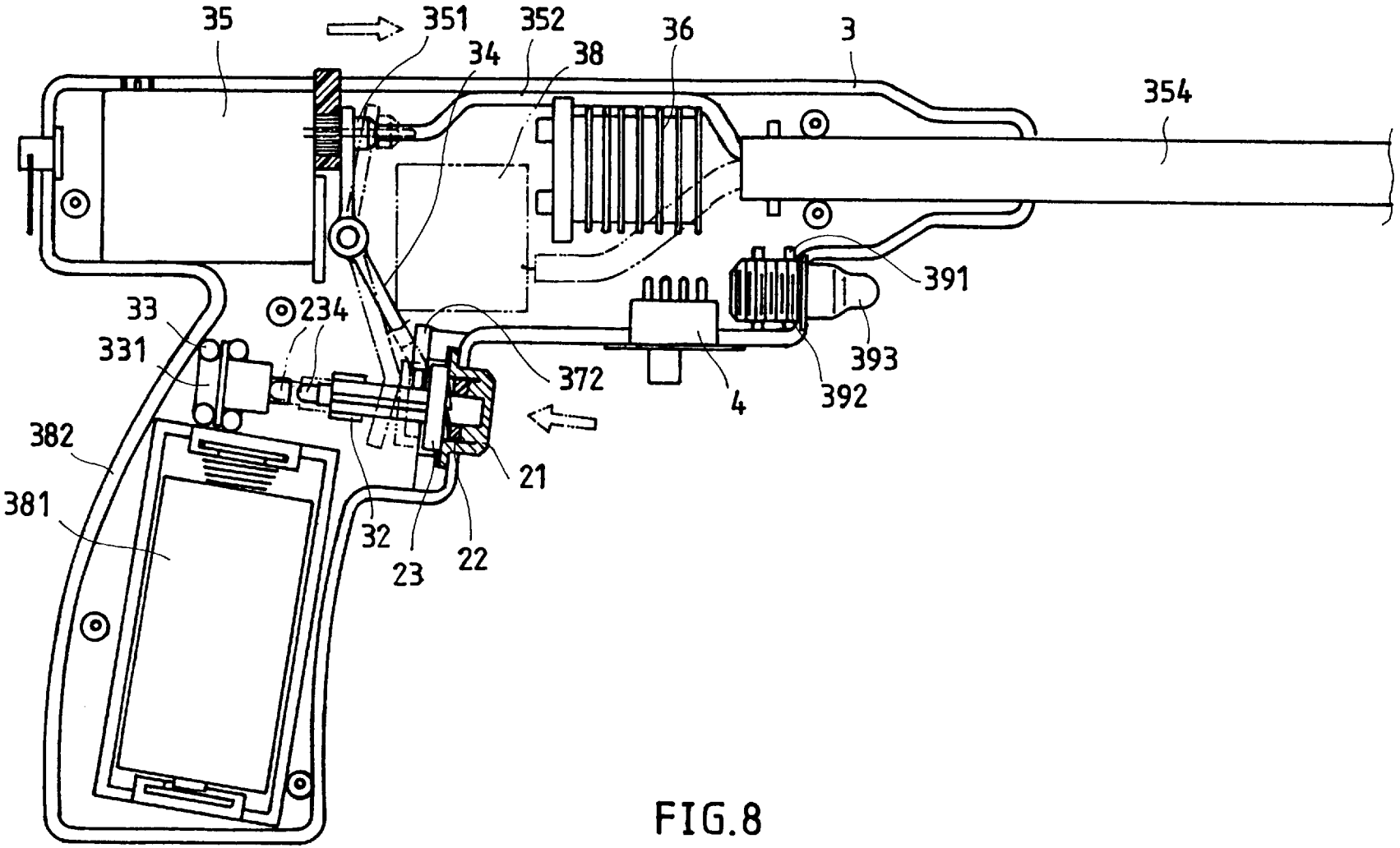
FIG. 8 is a sectional assembly view of the electronic lighter shown in FIG. 7.

FIG. 5 shows a safety electronic lighter according to a second embodiment of the present invention. This embodiment eliminates the aforesaid second power control switch 162. When in use, the control knob 21 is rotated to the operative position (where the ignition control switch 2 is allowed to be depressed), then the safety lock 171 is moved to the unlocking position, and then the ignition control switch 2 and the power control switch 151 are simultaneously depressed, enabling sparks to be produced, and fuel gas to be discharged out of the gas tank 25 and ignited by sparks at the flame tube 27.

FIGS. from 7 through 10 illustrate a safety electronic lighter according to a third embodiment of the present invention. The housing 3 of this third embodiment is shaped like a pistol, and formed of two symmetrical shells. The ignition control switch 2 is mounted in a hole 31 at the hand grip 382 of the housing 3. The ignition control switch 2 is comprised of a control knob 21, a driving element 22, and a control bar 23. The control bar 23 is mounted in an opening 321 at a projecting frame 32 inside the housing 3, having a bottom pin 234 downwardly extended from its bottom side, a top pin 231 raised from its top side, and a plurality of bevel steps 232 at its top side around the root of the top pin 231. The driving element 22 comprises a center hole 222, which receives the top pin 231 of the control bar 23, and two sets of bevel steps 221 respectively disposed at its top and bottom sides around the center hole 222. The bevel steps 221 at the bottom side of the driving element 22 are meshed with the bevel steps 232 at the control bar 23. The control knob 21 is covered on a part of the control bar 23, having a bottom chamber 213, which receives the driving element 22, a plurality of bevel steps 212 disposed inside the bottom chamber 213 and meshed with the bevel steps 221 at the top side of the driving element 22, and two projecting rods 211 raised from the periphery at two opposite sides and respectively inserted in respective grooves 311 in the hole 31 for enabling the control knob 21 to be rotated clockwise/counterclockwise within 90° angle. Stop strips (not shown) are provided in the grooves 311 to limit the angle of rotation of the control knob 21 within 90° angle, i.e., the control knob 21 is permitted to rotate through 90° angle in clockwise as well as counter-clockwise direction (see also FIGS. from 6A through 6C).

A power switch 331 is mounted in a switch holder 33 inside the housing 3 adjacent to the bottom pin 234 of the control bar 23. When the ignition control switch 2 is pressed down, the power switch 331 is triggered by the bottom pin 234 of the control bar 23, causing sparks to be produced, and at the same time a pull lever 34 is driven by the control bar 23 to pull open the valve 351 of a gas tank 35, enabling fuel gas to flow out of the gas tank 35 through a gas tube 352 to the front side of the lighter for combustion.

A high voltage coil 36 is provided in the housing 3 near the front side, and connected to a control circuit 38 and a battery 381, which is received in the hand grip 382. The control circuit 38 controls the high voltage coil 36 to discharge a high voltage in producing sparks for igniting fuel gas. Supporting members 391 are provided inside the housing 3 to hold a lamp holder 392, which holds a lamp bulb 393, which extends out of a hole (not shown) on the housing 3. A multi-step control switch 4 is mounted in a bottom hole 39 at the bottom side of the housing 3, and operated to turn off the circuit of the lighter, to turn on the circuit of the lighter, or to turn on the lamp bulb 393.

Figure 9:
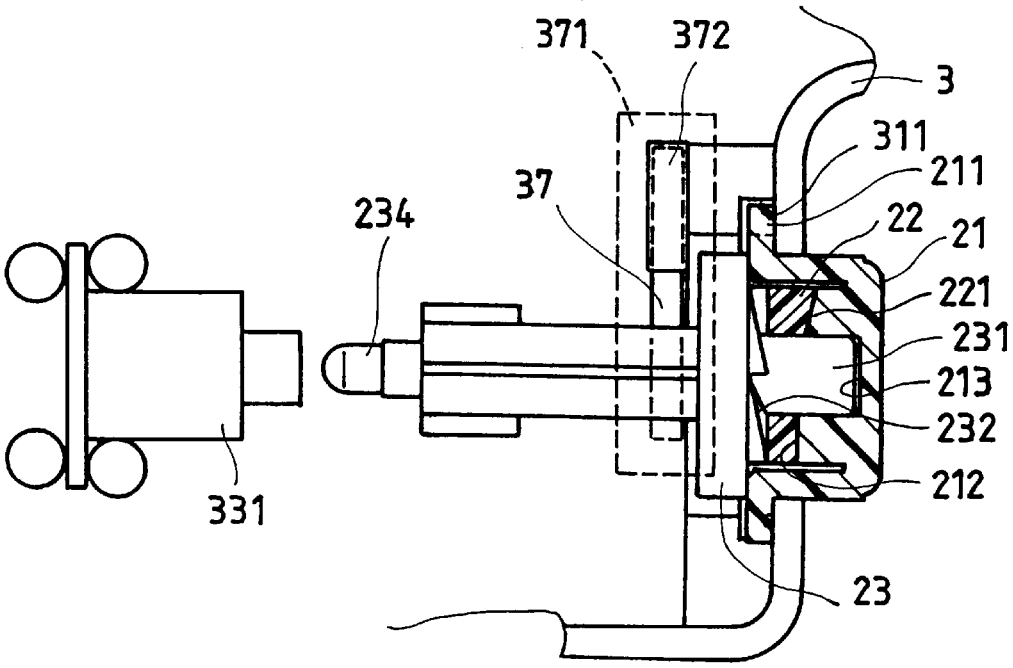
FIG. 9 is a sectional view in an enlarged scale of a part of the third embodiment of the present invention, showing the structure of the ignition control switch.
Figure 10:
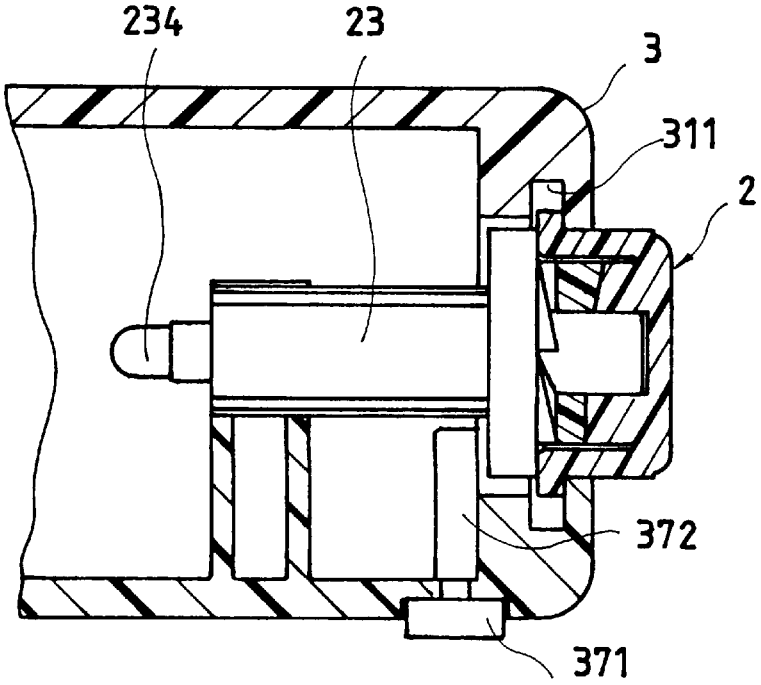
FIG. 10 is a sectional view in an enlarged scale of a part of the third embodiment of the present invention, showing the relationship between the ignition control switch and the safety lock.

A safety lock 371 is moved in a sliding slot 37 at one lateral side of the housing 3 adjacent to the ignition control switch 2, and operated to lock/unlock the ignition control switch 2. The safety lock 371 has a stop rod 372. When the safety lock 371 is shifted to the locking position, the stop rod 372 is stopped below the control bar 23 to prohibit the ignition control switch 2 from downward movement, and at the same time the control knob 21 is prohibited from rotary motion. On the contrary, when the safety lock 371 is shifted to the unlocking position, the stop rod 372 is moved away from the control bar 23, enabling the ignition control switch 2 to be depressed. The ignition control switch 2 is allowed to be depressed only when the control knob 21 is rotated to the position where the projecting rods 211 are aimed at respective notches 312 at the housing 3 (see FIGS. 9 and 10). When the ignition control switch 2 is depressed, the pull lever 34 is driven to pull open the valve 351, enabling fuel gas to flow out of the gas tank 35 through the gas tube 352 to the flame tube 354 for combustion, and at the same time the switch 331 is triggered, causing sparks to be produced between a central electrode 353 and the front end of the flame tube 354 (the flame tube 354 is a metal tube used as a side electrode), and therefore discharged fuel gas is burned up.

Figure 11:
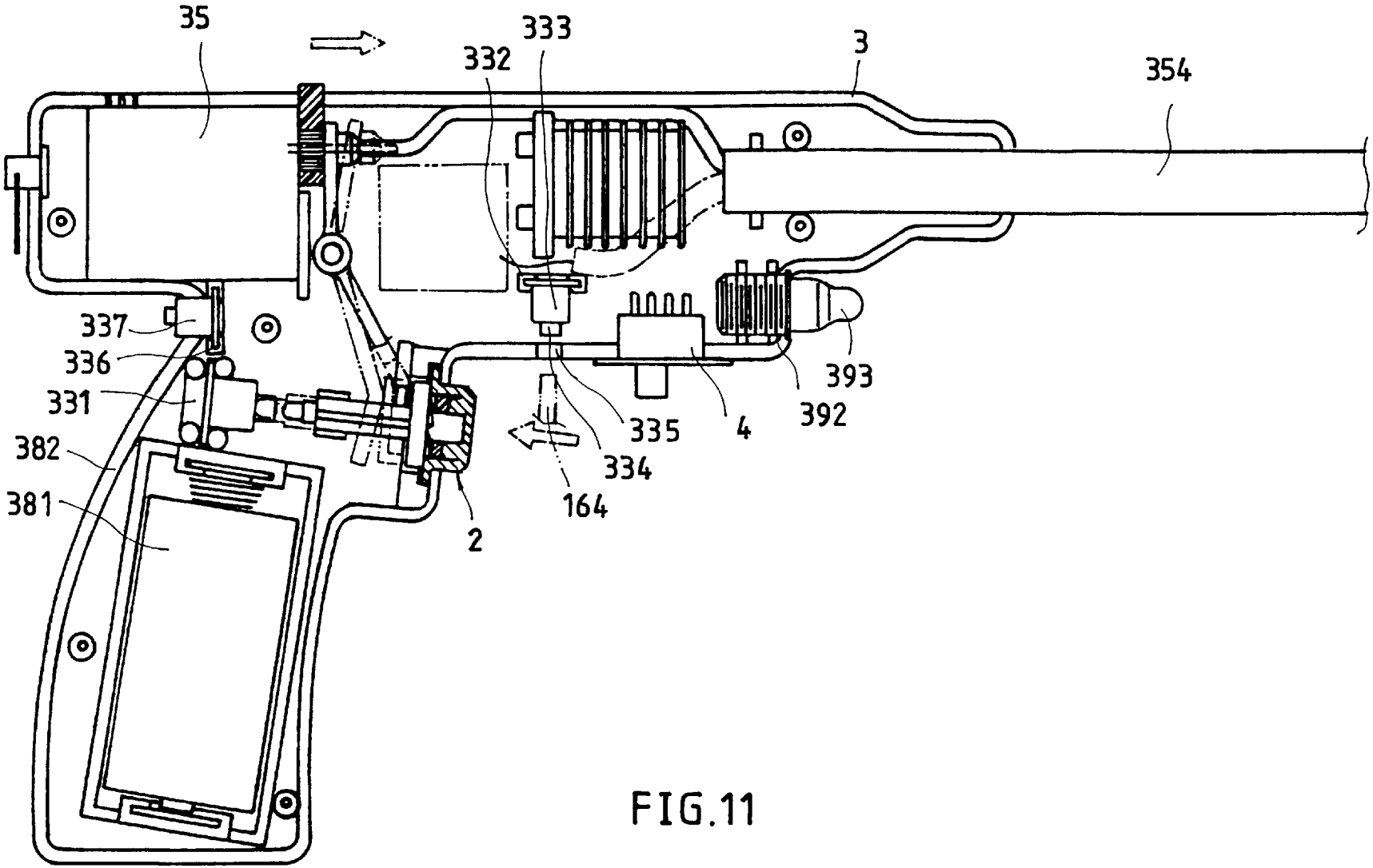
FIG. 11 is a sectional assembly view of a fourth embodiment of the present invention.

FIG. 11 illustrates a safety electronic lighter according to a fourth embodiment of the present invention. As illustrated, a power control switch 333 is mounted in a switch holder 332 inside the housing 3. The power control switch 333 has a press button 334 aimed at a hole 335 at the bottom side of the housing 3. When operating the power control switch 333, a rod member 164 or the like is inserted through the hole 335 and pressed on the press button 334 to switch on/off the power control switch 333. Another power control switch 337 is mounted in a switch holder 336 inside the hand grip 382. When igniting fuel gas, the control knob 21 is rotated to such a position that the projecting rods 211 are aimed at respective notches 312 at the housing 3, then the rod member 164 is inserted through the hole 335 to switch on the power control switch 333, and then the control knob 21 of the ignition control switch 2 and the power control switch 337 are simultaneously depressed to close the circuit of the high voltage coil 36, the control circuit 38 and the battery 381, enabling the high voltage coil 36 to discharge a high voltage in producing sparks.

It is to be understood that the drawings are designed for purposes of illustration only, and are not intended as a definition of the limits and scope of the invention disclosed.

What the invention claimed is:

1. A safety electronic lighter comprising a housing formed of two symmetrical shells, a gas tank mounted in said housing, a flame tube at a front side of said housing, a gas tank having a valve, a gas tube connected between said valve of said gas tank and said flame tube, a battery power supply circuit, a control circuit, a high voltage coil connected to said battery power supply circuit through said control circuit and controlled to discharge sparks, an ignition control switch operated to open said valve and drive said control circuit in controlling said high voltage coil to discharge sparks at said flame tube, and a safety lock controlled to lock said ignition control switch; wherein:

said housing comprises a top hole at a top side thereof on the middle, which receives said ignition control switch, two smoothly arched grooves disposed at a bottom side of said top hole, two notches bilaterally disposed between said grooves, a sliding slot at one lateral side thereof on the middle, a bottom hole at a bottom side thereof, and a switch holder on the inside adjacent to said bottom hole;

said ignition control switch comprises a control knob, a driving element, a control bar, and a spring, said control bar having a bottom pin downwardly extended from a bottom side thereof, a top pin raised from a top side thereof, a plurality of bevel steps at the top side around said top pin, an extension, and a metal strip at said extension, said spring being mounted inside said housing around said bottom pin of said control bar to support said control bar, said driving element comprising a center hole, which receives said top pin of said control bar and two sets of bevel steps respectively disposed at top and bottom sides thereof around the center hole, the bevel steps at the bottom side of said driving element being meshed with the bevel steps at said control bar, said control knob being covered on a part of said control bar, said control knob having a bottom chamber, which receives said driving element, a plurality of bevel steps disposed inside said bottom chamber and meshed with the bevel steps at the top side of said driving element, and two projecting rods raised from the periphery thereof at two opposite sides and respectively inserted in grooves at said housing for enabling said control knob to be rotated clockwise/counter-clockwise within 90° angle between the operative position where said projecting rods are aimed at the notches at said housing for enabling said control knob to be depressed to lower said control bar in triggering said control circuit, and the non-operative position where said projecting rods are moved away from said notches into said grooves to stop said control knob from downward movement;

said safety lock is moved in said sliding slot at said housing to lock/unlock said ignition control switch said safety lock having a stop rod, and being shifted between the locking position where said stop rod is stopped below said control bar to prohibit said ignition control switch from downward movement, and at the same time prohibit said control knob from rotary motion;

said battery power supply circuit comprises a battery set connected to said control circuit and said high voltage coil, a power control switch mounted in said switch holder and extended out of said housing through said bottom hole for operation by hand to close/open the circuit of said battery power supply circuit.

2. The safety electronic lighter of claim 1 wherein said housing further comprises a second switch holder and a second bottom hole; said battery power supply circuit further comprises a second power control switch mounted in said second switch holder inside said housing and connected in series to said first power control switch, said second power control switch comprising a switching control button aimed at said second bottom hole for operation by an external rod member being inserted through said second bottom hole to close/open the circuit of said battery power supply circuit.

3. A safety electronic lighter comprising a housing, a gas tank mounted in said housing, a flame tube at a front side of said housing, a gas tank having a valve, a lever coupled to said valve and driven to open said valve, a gas tube connected between said valve of said gas tank and said flame tube, a battery power supply circuit, a control circuit, a high voltage coil connected to said battery power supply circuit through said control circuit and controlled to discharge sparks, an ignition control switch operated to open said valve and drive said control circuit in controlling said high voltage coil to discharge sparks at said flame tube, and a safety lock controlled to lock said ignition control switch; wherein:

said housing is shaped like a pistol, comprising a hand grip at one end, a switch hole at said hand grip which receives said ignition control switch, a projecting frame inside said hand grip, said projecting frame having an opening, two smoothly arched grooves disposed at a bottom side of said hole, two notches bilaterally disposed between said grooves, a sliding slot at one lateral side thereof, a switch holder inside said hand grip, an insertion hole at a bottom side thereof, a lamp hole at a front side thereof, a second switch holder on the inside adjacent to said insertion hole, a bottom hole at a bottom side thereof, and lamp support means at a front side thereof behind said lamp hole;

said ignition control switch is mounted in the switch hole at the hand grip of said housing, said ignition control switch comprised of a control knob, a driving element, and a control bar, said control bar being mounted in the opening at the projecting frame inside said hand grip of said housing and coupled to said lever for enabling said lever to be driven to open said valve when said ignition control switch is depressed, said control bar comprising a bottom pin downwardly extended from a bottom side thereof, a top pin raised from a top side thereof, and a plurality of bevel steps at the top side around said top pin, said driving element comprising a center hole, which receives the top pin of said control bar, and two sets of bevel steps respectively disposed at top and bottom sides thereof around the center hole, the bevel steps at the bottom side of said driving element being meshed with the bevel steps at said control bar, said control knob being covered on a part of said control bar, said control knob comprising a bottom chamber, which receives said driving element, a plurality of bevel steps disposed inside said bottom chamber and meshed with the bevel steps at the top side of said driving element, and two projecting rods raised from the periphery thereof at two opposite sides and respectively inserted in the grooves in the switch hole at said hand grip for enabling said control knob to be rotated clockwise/counter-clockwise within 90° angle between the operative position where said projecting rods are aimed at the notches at said hand grip for enabling said control knob to be depressed to lower said control bar in triggering said control circuit, and the non-operative position where said projecting rods are moved away from said notches into said grooves to stop said control knob from downward movement;

said battery power supply circuit comprises a battery set, a first power switch mounted in the first switch holder inside said hand grip of said housing adjacent to the bottom pin of said control bar and triggered by the bottom pin of said control bar to close the circuit of said battery power supply circuit when said ignition control switch is pressed down, a second power control switch mounted in said second switch holder inside said housing and connected in series to said first power control switch, said second power control switch comprising a switching control button aimed at said insertion hole for triggering by an external rod member, a lamp holder mounted in said lamp support means and holding a lamp bulb in said lamp hole, and a multi-step control switch mounted in the bottom hole at the bottom side of said housing and operated to turn off the circuit of said battery power supply circuit, to turn on the circuit of said battery power supply circuit, or to turn on said lamp bulb;

said safety lock is moved in said sliding slot to lock/unlock said ignition control switch, said safety lock having a stop rod, and being shifted between the locking position where said stop rod is stopped below said control bar to prohibit said ignition control switch from downward movement, and at the same time prohibit said control knob from rotary motion.

4. A safety electronic lighter comprising:

a housing;

a gas tank mounted in said housing in fluid communication with a flame tube for emitting a flame from said housing;

electrical power supply means for generating electrical sparks at one end of said flame tube; said electrical power supply means including a battery, a high voltage coil, and a battery power supply circuit coupled to said battery;

an ignition control switch mounted on said housing and displaceable for electrical contact to said power supply means; and, a first power control switch mounted to said housing at a location on said housing remote from said ignition control switch and electrically coupled to said electrical power supply means whereby simultaneous actuation of said ignition control switch and said first power control switch discharges said electrical sparks.

5. The safety electronic lights as recited in claim 4 where said ignition control switch comprises a control knob, a driving element, a control bar, and a spring, said control bar having a bottom pin downwardly extended from a bottom side thereof, a top pin raised from a top side thereof, a plurality of bevel steps at the top side around said top pin, an extension, and a metal strip at said extension, said spring being mounted inside said housing around said bottom pin of said control bar to support said control bar, said driving element comprising a center hole, which receives said top pin of said control bar and two sets of bevel steps respectively disposed at top and bottom sides thereof around the center hole, the bevel steps at the bottom side of said driving element being meshed with the bevel steps at said control bar, said control knob being covered on a part of said control bar, said control knob having a bottom chamber, which receives said driving element, a plurality of bevel steps disposed inside said bottom chamber and meshed with the bevel steps at the top side of said driving element, and two projecting rods raised from the periphery thereof at two opposite sides and respectively inserted in grooves at said housing for enabling said control knob to be rotated clockwise/counter-clockwise within 90° angle between the operative position where said projecting rods are aimed at the notches at said housing for enabling said control knob to be depressed to lower said control bar in triggering said control circuit, and the non-operative position where said projecting rods are moved away from said notches into said grooves to stop said control knob from downward movement.

6. The safety electronic lights as recited in claim 4 where said ignition control switch is mounted on an upper surface of said housing and said first power control switch is mounted on a lower surface of said housing.

7. The safety electronic lighter as recited in claim 4 including:

a second power control switch mounted within said housing and electrically coupled to said electrical power supply means whereby simultaneous actuation of said ignition control switch, said first power control switch and said second power control switch discharges said electrical sparks.

8. The safety electronic lighter as recited in claim 7 where said second power control switch is positionally aligned with an opening formed through said housing for insert of a rod member to actuate said second power control switch.

9. The safety electronic lighter as recited in claim 4 including:

a safety lock member insertable through a housing opening for contacting said ignition control switch and electrically decoupling said ignition control from said electrical power supply means and preventing actuation of said ignition control switch.

10. A safety electronic lighter comprising:

a pistol grip housing having a main section and a handle section;

a gas tank mounted in said housing main section in fluid communication with a flame tube through a gas line for emitting a flame from said pistol grip housing;

electrical power supply means for generating electrical sparks at one end of said flame tube, said electrical power supply means including a battery, a high voltage coil, and a battery power supply circuit coupled to said battery;

a displaceable ignition control switch mounted on said housing handle section;

a power control switch mounted within said housing handle section being electrically coupled to said power supply means responsive to a displacement of said displaceable control switch; and, lever means coupled to said displaceable ignition control switch on one end thereof and to said gas line on an opposing end for opening said gas line responsive to a displacement of said displaceable ignition control switch.

11. The safety electronic lighter as recited in claim 10 including a safety lock member insertable through a housing opening for interrupting a displacement path of said ignition control switch and preventing contact of said ignition control switch with said power control switch.

* * * * *